US007069730B2

(12) United States Patent
Emmer et al.

(10) Patent No.: US 7,069,730 B2
(45) Date of Patent: Jul. 4, 2006

(54) LIQUID AND COMPRESSED NATURAL GAS DISPENSING SYSTEM

(75) Inventors: Claus D. Emmer, Prior Lake, MN (US); Jesse Gamble, Burnsville, MN (US); Craig Zelasko, Burnsville, MN (US); Thomas K. Drube, Lakeville, MN (US)

(73) Assignee: Chart Inc., Burnsville, MN (US)

( * ) Notice: Subject to any disclaimer, the term of this patent is extended or adjusted under 35 U.S.C. 154(b) by 0 days.

(21) Appl. No.: 10/654,289

(22) Filed: Sep. 2, 2003

(65) Prior Publication Data

US 2005/0016185 A1 Jan. 27, 2005

Related U.S. Application Data

(60) Provisional application No. 60/407,042, filed on Aug. 30, 2002.

(51) Int. Cl.

| | |
|---|---|
| ***F17C 7/02*** | (2006.01) |
| ***F17C 9/02*** | (2006.01) |
| ***F17C 7/04*** | (2006.01) |
| ***B65B 1/20*** | (2006.01) |
| ***B65B 1/28*** | (2006.01) |

(52) U.S. Cl. ..... 62/50.1; 62/50.2; 62/48.1; 141/11; 141/82

(58) Field of Classification Search ..... 62/50.1, 62/50.2, 45.1, 48.1; 141/11, 82
See application file for complete search history.

(56) References Cited

U.S. PATENT DOCUMENTS

| | | | | |
|---|---|---|---|---|
| 2,435,332 | A | | 2/1948 | Van Vleet et al. |
| 2,482,778 | A | | 9/1949 | Joerren |
| 4,175,395 | A | | 11/1979 | Prost et al. |
| 4,744,222 | A | | 5/1988 | Murai |
| 5,127,230 | A | | 7/1992 | Neeser et al. |
| 5,163,409 | A | | 11/1992 | Gustafson et al. |
| 5,231,838 | A | | 8/1993 | Cieslukowski |
| 5,315,831 | A | | 5/1994 | Goode et al. |
| 5,360,139 | A | * | 11/1994 | Goode ..... 222/40 |
| 5,373,702 | A | | 12/1994 | Kalet et al. |
| 5,421,160 | A | * | 6/1995 | Gustafson et al. ..... 62/7 |
| 5,505,232 | A | * | 4/1996 | Barclay ..... 141/11 |
| 5,537,824 | A | * | 7/1996 | Gustafson et al. ..... 62/7 |
| 5,590,535 | A | | 1/1997 | Rhoades |
| 5,682,750 | A | | 11/1997 | Preston et al. |
| 5,687,776 | A | | 11/1997 | Forgash et al. |
| 5,699,839 | A | | 12/1997 | Dehne |
| 5,771,946 | A | | 6/1998 | Kooy et al. |
| 5,924,291 | A | | 7/1999 | Weiler et al. |
| 6,044,647 | A | * | 4/2000 | Drube et al. ..... 62/50.1 |
| 6,354,088 | B1 | | 3/2002 | Emmer et al. |

* cited by examiner

*Primary Examiner*—William C. Doerrler
(74) *Attorney, Agent, or Firm*—DLA Piper Rudnick Gray Cary US LLP

(57) ABSTRACT

A system dispenses both liquid natural gas (LNG) and compressed natural gas (CNG). A bulk tank contains a supply of LNG which is pumped to a smaller storage tank. After the storage tank is refilled, LNG from the bulk tank is pumped to a vaporizer so that CNG is produced. The CNG may be routed to the LNG in the storage tank to condition it. It is also used to recharge a pressurizing cylinder that is placed in communication with the head space of the storage tank when it is desired to rapidly dispense LNG to a vehicle. A bank of cascaded storage cylinders alternatively may receive CNG from the vaporizer for later dispensing through the system CNG dispenser. The CNG from the vaporizer may also be dispensed directly via the system CNG dispenser.

18 Claims, 5 Drawing Sheets

LIQUID AND COMPRESSED NATURAL GAS DISPENSING SYSTEM

PRIORITY CLAIM

This application claims priority from U.S. Provisional Patent Application Ser. No. 60/407,042, filed Aug. 30, 2002, and currently pending.

BACKGROUND OF THE INVENTION

The present invention relates generally to systems for dispensing cryogenic fluids and, more particularly, to a self-contained system for dispensing liquid natural gas and compressed natural gas.

Economic and environmental concerns have resulted in widespread efforts to develop fuel substitutes for gasoline and diesel fuel. Natural gas, whose main component is methane, presents a viable alternative to gasoline and diesel fuel because it is relatively inexpensive, burns cleanly and produces emissions which are much less harmful to the environment. Both compressed natural gas (CNG) and liquid natural gas (LNG) have found use as alternative fuels in vehicles. Accordingly, it is desirable to have a system that can dispense both CNG and LNG.

LNG typically must be conditioned prior to dispensing so that it is in a saturated state at the pressure required by the vehicle to which it is being dispensed. In addition, LNG is typically dispensed from a dispensing station storage tank to a vehicle tank by pressurized transfer. It is desirable for this transfer to take place as quickly as possible so that a patron of the dispensing station does not have to wait for an extended period of time during refilling.

Historically, gases and liquid have been transferred rapidly between containers by making a big pressure differential between the fluid storage tank and the tank that is being filled (the receiving tank). There are typically two ways of doing this. The first is by starting out with the storage tank at a higher pressure than the receiving tank and then allowing this pressure to force the gas or liquid into the receiving tank. In so doing, product is transferred, but the pressure in the storage tank drops to the point where the pressures of the two tanks become equal and nothing more is transferred. Transfer can continue by using additional storage tanks, until they too equilibrate with the receiving tank. Such "cascade filling" is well known in the CNG industry. After use, the CNG storage tanks are typically slowly refilled with a compressor. While cascade filling works well in dispensing CNG, filling multiple tanks with liquid and then conditioning and pressurizing them is inefficient. As a result, cascade filling is not optimal for the rapid dispensing of LNG.

The second way of creating a large pressure differential between tanks so that fluid is rapidly transferred is to push liquid out of the storage tank by rapidly applying pressure to, or building pressure in, the head space of the storage tank. The gas required to create this pressure can come from an outside stored source, as in U.S. Pat. No. 6,044,647 to Drube et al., or can by found by vaporizing part of the liquid in the storage tank and turning into a vapor, as in U.S. Pat. No. 5,231,838 to Cieslukowski.

While the systems of the Drube et al. '647 patent and Cieslukowski '838 patent function well in dispensing LNG, they are unable to simultaneously dispense CNG. In addition, both systems, as with many prior art systems, require more than one heat exchanger to operate. This adds to system complexity and cost.

U.S. Pat. Nos. 5,421,160 and 5,537,824, both to Gustafson et al., disclose systems that can dispense both LNG and CNG. The systems of both of these patents, however, use compressors to compress the natural gas prior to storing it. This is a disadvantage as compressors introduce additional complexity, expense and maintenance requirements. In addition, each system also requires two heat exchangers which, as described above, also adds to system complexity and cost.

Pilot programs for testing and demonstrating the viability of LNG or CNG as fuel alternatives require pilot dispensing stations which are capable of efficiently storing large amounts of LNG and/or CNG and dispensing it to a fleet of vehicles. Because of the different storage requirements for LNG and conventional fuels, it is impractical and economically unfeasible to modify existing gasoline distribution facilities for LNG. It is therefore desirable to minimize the capital investment in site improvements required to install LNG and/or CNG pilot dispensing stations since it is difficult to recapture such outlays during the relatively short life of the facility. It is therefore also desirable to provide an LNG and CNG dispensing station that is portable and self-contained to permit quick transport and installation at distribution sites.

In prior art LNG dispensing systems, the storage tanks from which the LNG transfer to vehicles is made are traditionally filled by gravity. By opening a valve on the top and the bottom of the storage tank, liquid pours into it from a bulk tank or some other source. The valves are then closed, the liquid is conditioned to the right saturation point by bubbling a warm gas though it, and then an artificial pressure is created on the liquid with gas pressure to force it out of the tank.

An issue exists, however, as to how to create a method to fill the storage tank in a confined, height limited space. Such a situation may occur, for example, with a self-contained station positioned inside a 40 foot ISO container. Such an environment does not provide enough height to gravity fill the storage tank.

Accordingly, it is an object of the present invention to provide a system that can efficiently condition and rapidly dispense liquid natural gas.

It is another object of the present invention to provide a system that can dispense both liquid natural gas and compressed natural gas.

It is another object of the present invention to provide a system that can produce and dispense compressed natural gas without the use of a compressor.

It is still another object of the present invention to provide a system for dispensing compressed natural gas and liquid natural gas that is economical to construct and maintain.

It is still another object of the present invention to provide a system for dispensing compressed natural gas and liquid natural gas that will fit in a compact and portable space.

SUMMARY OF THE INVENTION

The present invention is a compact and self-contained system for dispensing both liquid natural gas (LNG) and compressed natural gas (CNG). The system includes a bulk tank containing a supply of cryogenic liquid. A pump is in communication with the bulk tank and directs LNG therefrom to a smaller storage tank, which is part of the system LNG Module.

The system may be reconfigured so that a vaporizer alternatively receives LNG from the pump and vaporizes it to create CNG. The vaporizer may direct the CNG to the LNG in the storage tank via a dip tube to saturate it at the pressure required by the vehicle to which it is dispensed. CNG from the vaporizer may alternatively be directed to a pressurizing cylinder so as to recharge it. When dispensing of LNG is desired, the head space of the storage tank is placed in communication with the pressurizing cylinder so that the LNG may be rapidly dispensed.

The CNG from the vaporizer may alternatively be routed to the CNG Module of the system. The CNG Module includes a bank of cascaded storage cylinders which receive and store the CNG from the vaporizer for later dispensing via the system CNG dispenser to a vehicle or other use device. The CNG alternatively may be routed directly from the vaporizer to the vehicle via the system CNG dispenser. An odorizer communicates with the outlet of the vaporizer to add odorant to the CNG in accordance with safety regulations.

Operation of the system may be automated by a controller that communicates with the pump, system valves and pressure, temperature and liquid level sensors or gages. In addition, the system pump may be submerged in LNG in the bulk tank or a sump to eliminate cool-down time.

The following detailed description of embodiments of the invention, taken in conjunction with the appended claims and accompanying drawings, provide a more complete understanding of the nature and scope of the invention.

DESCRIPTION OF THE PREFERRED EMBODIMENTS

Figure 1:
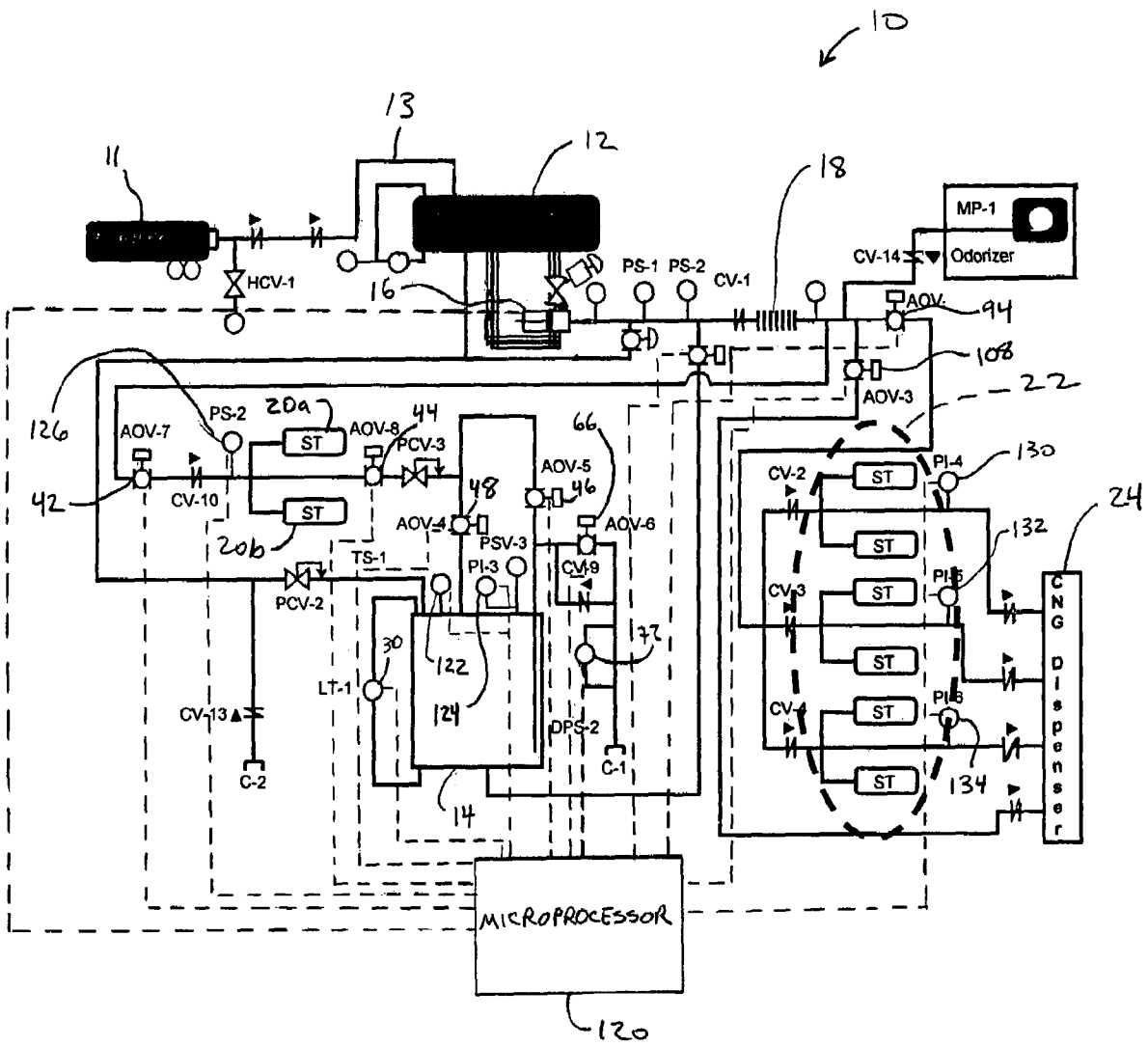
FIG. 1 is a schematic of an embodiment of the liquid and compressed natural gas dispensing system of the present invention.

An embodiment of the system of the present invention is indicated in general at 10 in FIG. 1. The system 10 is self-contained and dispenses liquid natural gas (LNG) and compressed natural gas (CNG) from a horizontal cryogenic bulk tank, indicated at 12, at sites where limited height requirements are an issue. The system, including the bulk tank 12, may be housed, for example, within a 40 foot ISO container and thus may be rapidly installed at a site either temporarily or permanently. The system, as explained below, may also be easily automated.

While the system of the present invention is described below in terms of dispensing CNG and LNG to vehicles, it could alternatively be used dispense other types of cryogenic fluids to other types of use devices.

The bulk tank 12 of the system 10 preferably has a capacity of approximately 5000 gallons for storing LNG. It may be refilled by a transport 11 carrying a supply of LNG through line 13. The system 10 also includes a smaller LNG storage tank, indicated at 14, that preferably has a volume between 150 gallons to 300 gallons.

As will be described in greater detail below, a pump 16 transfers LNG from the bulk storage tank to either the smaller liquid storage tank 14 or a vaporizer 18 whereby CNG is produced. The pump is preferably a high pressure reciprocating pump with a relatively low flow rate (such as 3 to 4 gallons per minute). The CNG is either routed to pressurizing cylinders 20*a* and 20*b*, for use in pressurizing the LNG in storage tank 14, or to a bank of cascaded storage cylinders, indicated in phantom at 22, for storage or dispensing directly via dispenser 24.

Figure 2:
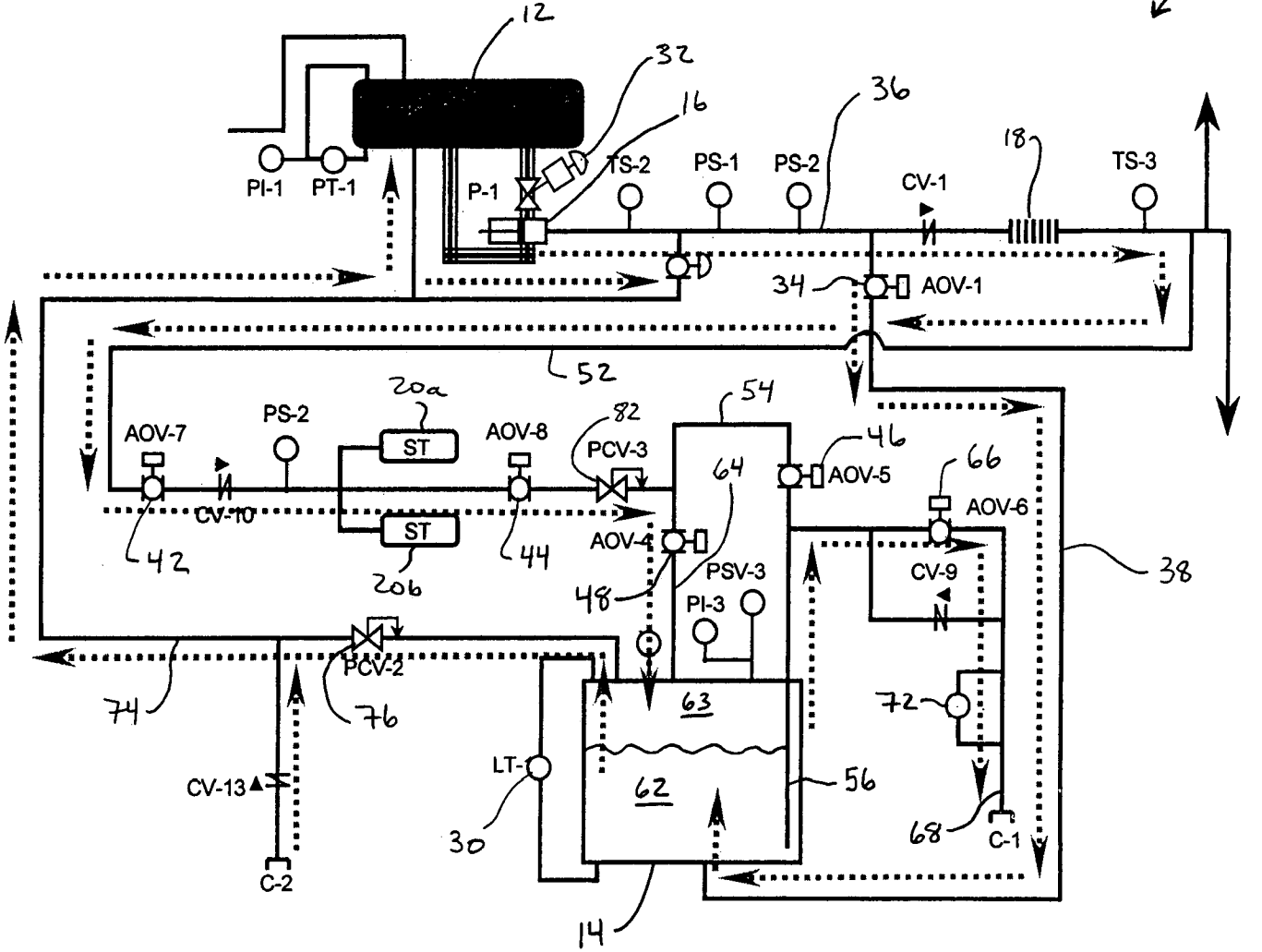
FIG. 2 is an enlarged schematic of the liquid natural gas portion of the system of FIG. 1.

The LNG portion (or "LNG Module") of the system is indicated in general at 29 in FIG. 2. A liquid level gauge 30 detects the quantity of LNG in storage tank 14. When the LNG level in tank 14 drops below a predetermined level, valves 32 and 34 are opened and pump 16 is activated. As a result, LNG flows to storage tank 14 through lines 36 and 38. Due to the action of pump 16, the incoming LNG is warmer than the LNG in the tank 14. The warmer LNG enters tank 14 through its bottom so as to allow the incoming LNG to mix with the LNG already present in the tank so as to raise its temperature to saturate it at the pressure required by the vehicle being filled.

When the liquid level gauge 30 indicates that the storage tank 14 has been filled to the appropriate level, valves 32 and 34 are closed and the flow of LNG into tank 14 terminates. As such, the liquid level gauge 30 can also be used as a meter to determine the amount of LNG dispensed by the last patron to use the system. More specifically, the amount of LNG dispensed may be calculated by comparing the liquid level at the start of the refill of the storage tank 14 with the liquid level in storage tank 14 at the end of the refill. The tank may optionally be provided with a second opening and a meter, such as a turbine meter, for example, may be attached and used to determine how many gallons (liters/meters, etc) were dispensed.

The heat provided by the LNG added during the refill of storage tank 14 may not be sufficient to bring the LNG therein to saturation at the desired temperature and pressure. Under such circumstances, it is necessary to divert some of the LNG leaving pump 16 through vaporizer 18 so that CNG is produced and directed to the storage tank 14. This is accomplished by closing valve 34 and opening valves 42, 44 and 46. It should be noted that valve 48 remains closed. As a result, LNG from bulk tank 12 travels through lines 36, 52 and 54 to dip tube 56. The warmer CNG gas bubbles through the LNG 62 in the storage tank until it is saturated at the desired pressure (as dictated by the requirements of the vehicle being refilled). The bubbling gas from the dip tube also serves to mix and stir the LNG in the storage tank 14.

CNG from vaporizer 18 may alternatively be routed to pressurizing cylinders 20*a* and 20*b* for use in pressurizing the storage tank 14 during dispensing of LNG. This is accomplished by closing valve 44. The pressure within pressurizing cylinders is maintained at approximately 4500 psi. Once storage tank 14 is filled with LNG, and the LNG therein is conditioned, and the pressurizing cylinders 20*a* and 20*b* are recharged, pump 16 may be shut off so that the flow of LNG from the bulk tank 12 terminates. Valve 42 is then closed. Alternatively, as described in greater detail below, pump 16 may continue to send LNG through vaporizer 18 for use in recharging the cascaded cylinders 22 (FIGS. 1 and 3).

When it is desirable to dispense LNG, the storage tank 14 may be quickly pressurized by CNG from the pressurizing cylinders 20*a* and 20*b*. This is accomplished by opening valves 44 and 48 so that CNG enters the head space 63 of storage tank 14 through line 64. Valve 66 is opened and, as a result, LNG is transferred to the vehicle tank at around 40 GPM through dispensing line 68. The LNG dispenser includes a flow sensor 72 which detects a reduced flow as the vehicle tank becomes full and automatically terminates dispensing.

Storage tank 14 is provided with a pressure relief line 74 that is equipped with pressure relief valve 76. When the pressure within storage tank 14 exceeds a predetermined level, which may occur during refilling or when the tank is sitting idle, pressure relief valve 76 opens to permit vapor to flow back to bulk tank 12. As a result, the pressure within storage tank 14 is relieved. Alternatively, if the pressure within tank 14 is above the setting of pressure relief valve 82, gas from the head space of storage tank 14 may be used to recharge pressurizing cylinders 20*a* and 20*b* when valve 44 is opened.

Figure 3:
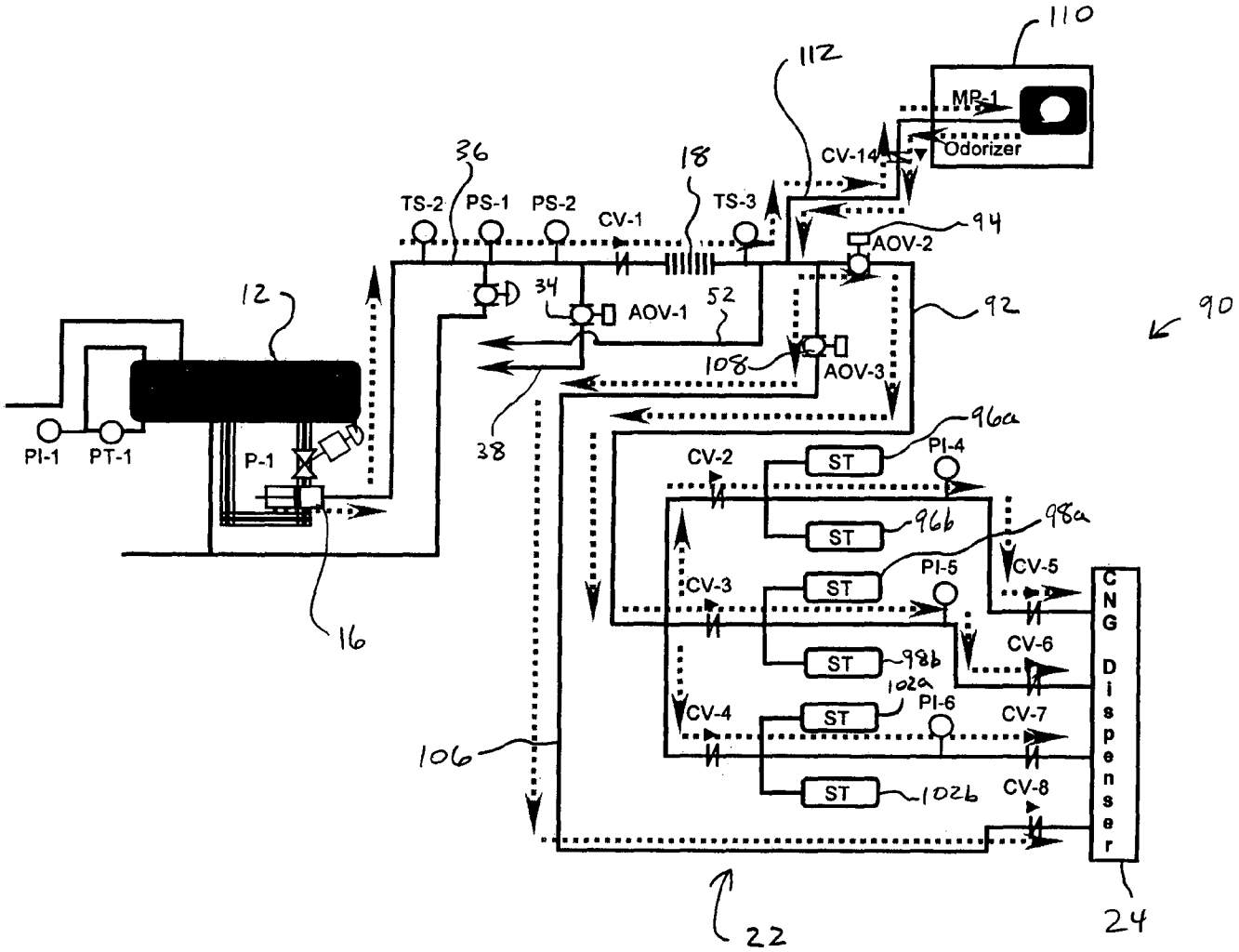
FIG. 3 is an enlarged schematic of the compressed natural gas portion of the system of FIG. 1.

The CNG portion (or "CNG Module") of the system is indicated in general at 90 in FIG. 3. As described previously with regard to FIG. 2, LNG from the bulk tank 12 is pumped via pump 16 through line 36 either to the LNG Module via line 38, through valve 34, or to vaporizer 18. CNG from vaporizer 18 may travel to the LNG Module through line 52. CNG from the vaporizer 18 travels to the CNG Module through line 92 when valve 94 is open.

The CNG traveling through line 92 is routed to a bank of cascaded storage cylinders, indicated in general at 22, for later dispensing. The bank 22 consists of three sets of cascaded CNG storage cylinders 96*a* and 96*b*, 98*a* and 98*b* and 102*a* and 102*b*. The bank 22 supports a CNG dispenser 24 capable of operating at either 3000 or 3600 psi of pressure. The bank and system may be sized, however, to provide much higher pressures (such as 5000 to 10000 psi).

A bypass line 106 permits CNG from the vaporizer to be routed directly to a use device via dispenser 24 instead of the storage cylinder bank. This is accomplished by opening valve 108 and closing valve 94.

An optional CNG odorizer 110 releases a measured amount of odorant via line 112 into the CNG flow leaving vaporizer 18 to meet local safety requirements. The station is also equipped with methane and heat detectors that will shut down the station in the event of an LNG/CNG release or fire. Suitable odorizers and detectors are well known in the art.

As stated previously, the system may be easily automated so that an adequate supply of LNG and CNG is available for dispensing. This is accomplished via a controller, indicated at 120 in FIG. 1. As illustrated in FIG. 1, the controller 120 communicates with pump 16 and LNG Module valves 42, 44, 46, 48 and 66. In addition, the controller communicates with liquid level gage 30, temperature sensor or gage 122 and pressure sensor or gage 124, all of which communicate with LNG storage tank 14. In addition, the controller 120 communicates with pressure sensor or gage 126, which provides the pressure within pressurizing cylinders 20*a* and 20*b*, and flow sensor 72. As a result the controller, which may, for example, be a microprocessor, operates the valves so that the process for filling, conditioning and pressurizing the LNG in the storage tank 14, and recharging of pressurizing cylinders 20*a* and 20*b*, is automated.

The controller 120 also communicates with valves 94 and 98 of the CNG Module. In addition, the controller communicates with pressure sensors or gages 130, 132 and 134, which indicate the pressures in each of the three sets of cascaded cylinders in bank 22. As a result, operation of the valves may be controlled by the controller so that the processes described above for the CNG Module are also automated.

Figure 4:
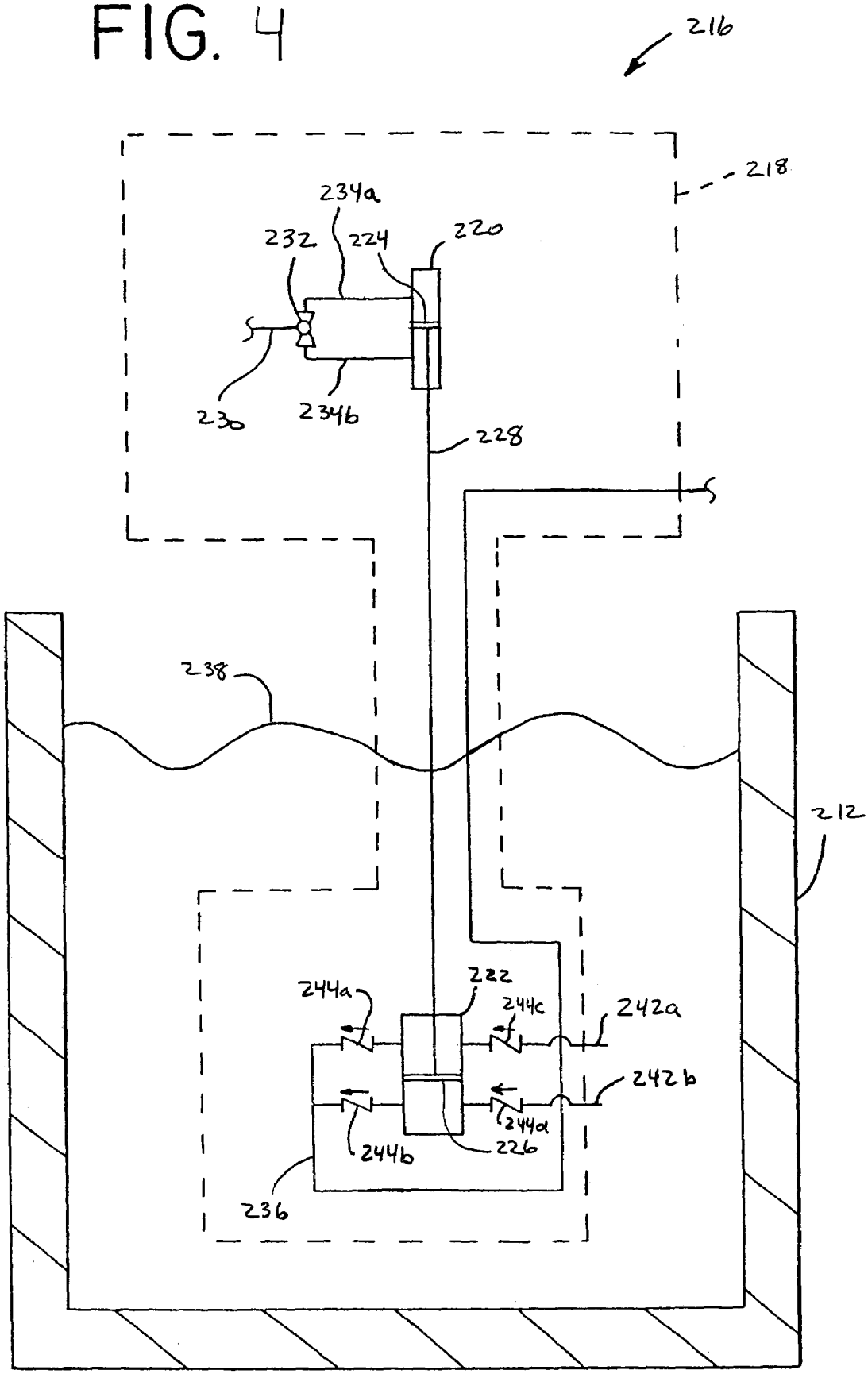
FIG. 4 is an enlarged schematic of the pump and bulk tank of a second embodiment of the system of the present invention.

While the pump 16 may be positioned external to the bulk tank 12, as illustrated in FIGS. 1–3, pump cool-down time is eliminated if the pump is submerged in the LNG within the bulk tank. Such an arrangement is illustrated in FIG. 4. A preferred embodiment of the pump, indicated in general at 216, features a housing, indicated in phantom at 218, that houses hydraulic cylinder 220 and pumping cylinder 222. Hydraulic cylinder 220 and pumping cylinder 222 are each divided by sliding hydraulic and pumping pistons 224 and 226, respectively. Hydraulic and pumping pistons 224 and 226 are joined by connecting rod 228. Double-acting, reciprocating pumps such as pump 216 are known in the art. An example of a suitable pump and hydraulic cylinder arrangement is illustrated in U.S. Pat. No. 5,411,374 to Gram. An example of a suitable pump flow rate is 15 gallons per minute.

Hydraulic cylinder 220 receives pressurized hydraulic fluid from a source (not shown) through line 230. Hydraulic fluid flowing towards the hydraulic cylinder through line 230 encounters an automated control valve 232. Depending on the setting of valve 232, the hydraulic fluid travels either to the upper or lower portion of the hydraulic cylinder through lines 234*a* or 234*b*, respectively. The provision of hydraulic fluid in an alternating fashion to the upper and lower portions of hydraulic cylinder 220 causes piston 224 to reciprocate so that pumping piston 226 is actuated by connecting rod 228. It is to be understood, however, that alternative types of linear actuators may be used in place of hydraulic cylinder 220 and piston 224. These include, but are not limited to, electric actuators, motor and cam arrangements and hybrids.

As illustrated in FIG. 4, the lower portion of housing 218 containing pumping cylinder 222 and piston 226 is submerged in the LNG 238 of bulk tank 212 (which corresponds to bulk tank 12 of FIGS. 1–3). When pumping piston 226 is actuated, LNG 238 travels through liquid inlets 242*a* and 242*b* in an alternating fashion due to the action of check valves 244*a*, 244*b*, 244*c* and 244*d*. Pumped LNG leaving the pumping cylinder 222 travels through line 236 (which corresponds to line 36 in FIGS. 2 and 3) to the remaining portion of the system.

Keeping the liquid side or "cold end" of the pump submerged in the cryogen eliminates the need for pump cool-down prior to dispensing. More specifically, the pumping piston 226 and cylinder 222 would vaporize liquid cryogen if they were permitted to become warm between uses of the pump. Keeping the pumping piston and cylinder cool therefore eliminates the two-phase flow through the pump that could otherwise occur.

Figure 5:
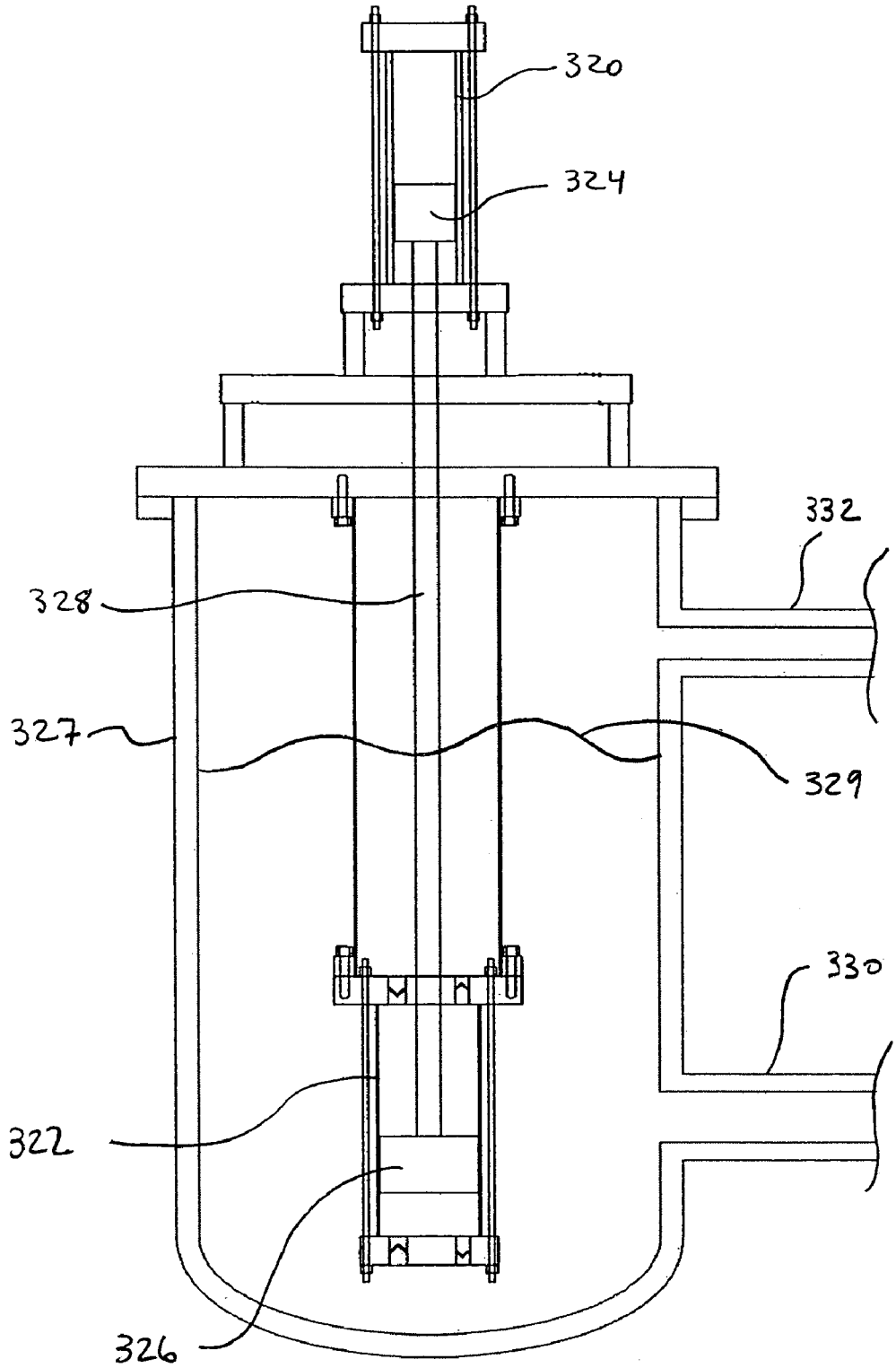
FIG. 5 is an enlarged schematic of the pump and a sump of a third embodiment of the system of the present invention.

As an alternative to the arrangement illustrated in FIG. 4, the system of FIGS. 1–3 may be constructed with the system pump positioned in a sump. More specifically, as illustrated in FIG. 5, the actuating hydraulic cylinder and piston 320 and 324, respectively, are positioned on top of a sump 327 so that the pumping cylinder 322 and piston 326, and a portion of connecting rod 328, are submerged in LNG 329. The sump 327 receives LNG 329 from the bulk tank 12 of FIGS. 1–3 through inlet line 330. Displaced vapor and any liquid overflow from sump 327 return to the headspace of the bulk tank through outlet line 332.

The present invention thus offers a self-contained, preassembled and tested system that is capable of dispensing both LNG and CNG. As a result, it is unnecessary to have separate stations for each type of vehicle. The system of the present invention may be mounted inside an appropriate container, such as an ISO container, so as to provide for quick installation and simple security (via the container doors). Such an installation would be inherently stable and require minimal foundation and it would also be able to be relocated. The operation of the system provides for preloaded LNG and CNG for quick and efficient fueling of both LNG and CNG powered vehicles.

While the preferred embodiments of the invention have been shown and described, it will be apparent to those skilled in the art that changes and modifications may be made therein without departing from the spirit of the invention, the scope of which is defined by the appended claims.

What is claimed is:

1. A system for dispensing cryogenic fluids comprising:

a) a bulk tank containing a supply of cryogenic liquid;

b) a pump in communication with the bulk tank;

c) a storage tank selectively in communication with the bulk tank so as to receive cryogenic liquid therefrom;

d) a vaporizer selectively in communication with the pump, said vaporizer receiving cryogenic liquid from the bulk tank via the pump so that a cryogenic gas is produced and said vaporizer selectively communicating directly with the storage tank so as to condition the liquid therein;

e) a bank of cascaded storage cylinders selectively in communication with the vaporizer so as to receive gas therefrom for dispensing; and f) a pressurizing cylinder separate and distinct from the bank of cascaded storage cylinders and selectively in communication with the vaporizer so as to receive cryogenic gas therefrom, said pressurizing cylinder pressurizing said storage tank with gas so that the liquid in the storage tank may be dispensed therefrom while gas is simultaneously dispensed from the bank of cascaded storage cylinders.

2. The system of claim 1 wherein the vaporizer communicates with the storage tank via a dip tube disposed within the liquid therein.

3. The system of claim 1 wherein the gas from the pressurizing cylinder is provided to the head space of the storage tank.

4. The system of claim 1 further comprising a gas dispenser in communication with the bank of cascaded storage cylinders.

5. The system of claim 4 wherein the vaporizer also selectively communicates with the gas dispenser so that gas may be dispensed directly from the vaporizer.

6. The system of claim 4 further comprising an odorizer in circuit between the vaporizer and the gas dispenser.

7. The system of claim 1 further comprising an odorizer in circuit between the vaporizer and the storage cylinder.

8. The system of claim 1 further comprising a controller and a liquid level gage in communication with the storage tank, said controller communicating with the pump and the liquid level gage so that the pump is activated and the storage tank is automatically refilled when the liquid therein drops to a predetermined level.

9. The system of claim 8 further comprising a pressure sensor in communication with the pressurizing cylinder and a valve that directs liquid from the pump to the vaporizer and alternatively to the storage tank, said controller in communication with the pressure sensor and the valve so that the pressurizing cylinder is automatically recharged with gas from the vaporizer with the pressure therein drops to a predetermined level.

10. The system of claim 1 further comprising a controller and a pressure sensor in communication with the storage cylinder, said controller communicating with the pump and the pressure sensor so that the pump is activated and the storage cylinder is automatically recharged with gas when the pressure therein drops to a predetermined level.

11. The system of claim 1 wherein the pump is a double-acting, reciprocating pump.

12. The system of claim 1 wherein the pump is positioned within the bulk tank so as to be at least partially submerged in the cryogenic liquid therein.

13. The system of claim 1 further comprising a sump in communication with the bulk tank so as to receive cryogenic liquid therefrom and wherein the pump is positioned in the sump so as to be at least partially submerged in cryogenic liquid.

14. A method of dispensing a cryogenic gas and a cryogenic liquid comprising the steps of:

a) providing a supply of liquid in a bulk tank;

b) providing a liquid storage tank, a pressurizing cylinder and a gas storage cylinder;

c) transferring the liquid to the liquid storage tank;

d) vaporizing liquid from the bulk tank so as to produce a gas;

e) transferring a portion of the gas to the gas storage cylinder and another portion of the gas to the pressurizing cylinder;

f) transferring another portion of the gas to the liquid storage tank to condition the liquid therein;

g) dispensing conditioned liquid from the liquid storage tank using gas from the pressurizing cylinder to pressurize the liquid storage tank; and h) simultaneously dispensing gas from the gas storage cylinder.

15. The method of claim 14 further comprising the step of adding odorant to the gas prior to step e).

16. The method of claim 14 further comprising the step of dispensing gas from the vaporizer directly.

17. The method of claim 14 further comprising the steps of monitoring a liquid level in the liquid storage tank and a pressure level in the gas storage cylinder and refilling and recharging each, respectively, when the levels therein drop below predetermined levels.

18. A system for dispensing cryogenic fluids comprising:

a) a bulk tank containing a supply of cryogenic liquid;

b) a pump in communication with the bulk tank;

c) a vaporizer selectively in communication with the pump, said vaporizer receiving cryogenic liquid from the bulk tank via the pump so that a cryogenic gas is produced;

d) a CNG module including a bank of cascaded storage cylinders selectively in communication with the vaporizer so as to receive gas therefrom for later dispensing; and e) an LNG module separate and distinct from the CNG module including:

i. a storage tank selectively in communication with the bulk tank so as to receive cryogenic liquid therefrom and selectively in direct communication with the vaporizer to receive cryogenic gas therefrom to condition the cryogenic liquid in the storage tank;

ii. a pressurizing cylinder selectively in communication with the vaporizer so as to receive cryogenic gas therefrom, said pressurizing cylinder pressurizing said storage tank with gas so that the liquid in the storage tank may be dispensed therefrom as gas is simultaneously dispensed from the bank of cascaded storage cylinders.

* * * * *